US011166576B2

(12) United States Patent
Howell

(10) Patent No.: US 11,166,576 B2
(45) Date of Patent: Nov. 9, 2021

(54) MULTI-USE RECYCLABLE DRINKING STRAW

(71) Applicant: Bret Howell, Spokane, WA (US)

(72) Inventor: Bret Howell, Spokane, WA (US)

( * ) Notice: Subject to any disclaimer, the term of this patent is extended or adjusted under 35 U.S.C. 154(b) by 224 days.

(21) Appl. No.: 16/567,883

(22) Filed: Sep. 11, 2019

(65) Prior Publication Data

US 2021/0068569 A1 Mar. 11, 2021

(51) Int. Cl.
*A47G 21/18* (2006.01)

(52) U.S. Cl.
CPC ..... *A47G 21/182* (2013.01); *A47G 21/18* (2013.01)

(58) Field of Classification Search
CPC ..... A47G 21/18; A47G 21/182
USPC ..... 239/24, 33, 602
See application file for complete search history.

(56) References Cited

U.S. PATENT DOCUMENTS 9,820,597 B1 * 11/2017 Chang ..... B23K 26/364
10,159,369 B2 12/2018 MacDonald
2004/0256015 A1 * 12/2004 Margetson ..... A47G 21/188 138/109
2011/0121094 A1 * 5/2011 Burney ..... A47G 21/182 239/24
2012/0145372 A1 * 6/2012 Baldrige ..... A47G 21/183 165/177
2019/0099025 A1 * 4/2019 Rieger ..... A47G 21/182
2020/0107661 A1 * 4/2020 Lin ..... A47G 21/18
2021/0015282 A1 * 1/2021 Porter ..... A47G 21/186

* cited by examiner

*Primary Examiner* — Steven J Ganey
(74) *Attorney, Agent, or Firm* — FIG. 1 Patents

(57) ABSTRACT

In aspects of a multi-use recyclable drinking straw, the drinking straw has an elongated housing with a continuous sidewall that encloses a void space conducive for conducting a liquid, and the continuous sidewall is formed with recyclable material that is both rigid to sustain use as a beverage straw and collapsible for recycling. The drinking straw also has a contact area of the elongated housing that provides a temperature indication of the liquid, where the temperature indication serves as a hot beverage safety warning to a user of the drinking straw. The multi-use recyclable drinking straw can include a first configuration as a beverage straw with the continuous sidewall of the elongated housing having an oval cross section, and can include a second configuration as a beverage stir stick, where the elongated housing is collapsible such that the continuous sidewall has a flattened cross section conducive for stirring the liquid.

20 Claims, 3 Drawing Sheets

MULTI-USE RECYCLABLE DRINKING STRAW

BACKGROUND

Millions of plastic drinking straws are used and disposed of each day, after only a single use. Generally, our society has accepted the convention that straws are a one-time use product. However, plastic drinking straws are not recyclable, end up in sanitation landfills and worse yet, find a way into our waterways and oceans where marine life and birds ingest the plastic and die. Notably, instances of single-use plastic straws being banned are more commonplace in an effort to curb, or at least slow, this ever-increasing environmental problem. Many users, however, continue to use plastic straws for the conveniences and ease of beverage consumption that they provide. Another notable drawback is that a user may not be able to get a sense of just how hot a beverage is. When holding a beverage container, a user may sense a general notion of whether a liquid beverage is relatively hot, relatively cold, or whether the temperature of the beverage is generally imperceptible. Due to the insulating properties of beverage containers, and with the advent of sleeves and hot drink jackets, a user may not be able to perceive or determine just how hot a liquid beverage is and may burn themselves drinking the hot beverage through a plastic straw.

BRIEF DESCRIPTION OF THE DRAWINGS

Implementations of aspects of a multi-use recyclable drinking straw are described with reference to the following Figures. The same numbers may be used throughout to reference like features and components shown in the Figures.

DETAILED DESCRIPTION

Figure 1:
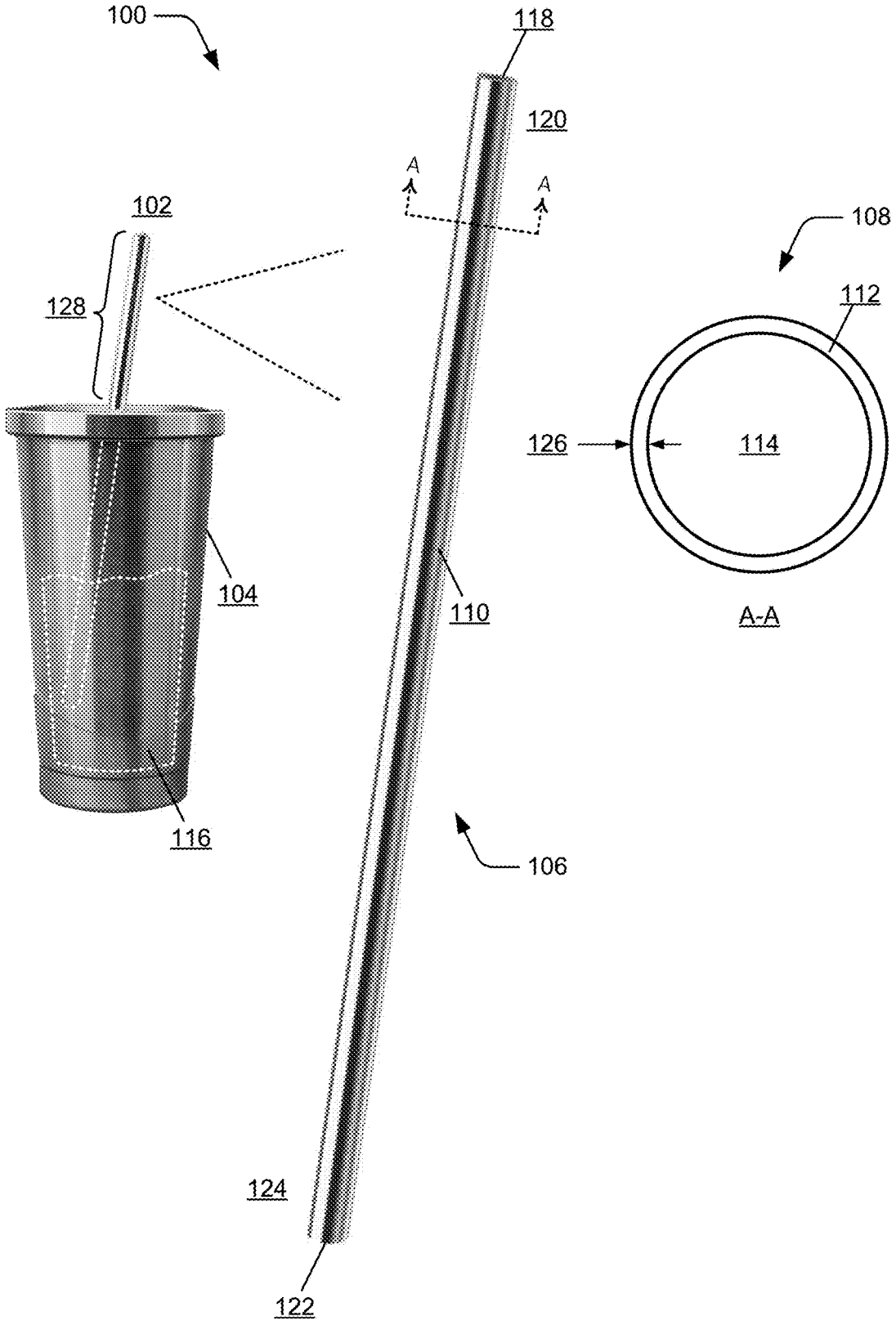
FIG. 1 illustrates an example of a multi-use recyclable drinking straw in accordance with one or more implementations of the aspects described herein.

Implementations of a multi-use recyclable drinking straw are described, and provide an aluminum drinking straw that can sustain use as a "one-day straw" or an "all-day straw" and is environmentally friendly and recyclable. The multi-use recyclable drinking straw is thin-walled, yet rigid enough for multi-use, and inexpensive enough to replace the single-use plastic straws that are already being banned with a recyclable consumer product. A multi-use recyclable drinking straw can still be used by those that will still consider straws a one-time use product, in which case they will be recycled rather than contributing to the ever-increasing environmental plastic problem. However, others who are environmentally conscious can utilize a multi-use recyclable drinking straw many times over during the course of a day, a week, or even longer. This provides an optimal user experience, both for those who wish to reuse a multi-use recyclable drinking straw multiple times, and also for those who want to be able to recycle straws, but may be concerned about using a straw more than once or more than a day for perceived hygiene reasons.

If a person generally uses only two straws a day, such as for a coffee in the morning and a refreshment at lunch, then simply using a multi-use recyclable drinking straw for both beverages would eliminate approximately half of the plastic straws that are disposed of daily. Adding the aspect of also being recyclable provides a great advancement in the efforts to curb or eliminate the looming environmental disaster that is plastic straws. Additionally, using aluminum to form a multi-use recyclable drinking straw provides a consumer a noticeably more refreshing experience for any temperature of a beverage. Notably, a multi-use recyclable drinking straw accentuates the temperature safely and has a very clean and pure taste compared to conventional plastic and/or paper straws.

In aspects of a multi-use recyclable drinking straw as described herein, the drinking straw has an elongated housing with a continuous sidewall that encloses a void space conducive for conducting a liquid therethrough, such as a liquid contained in a beverage container. In an implementation, the continuous sidewall of the elongated housing has a circular cross-section, forming the multi-use recyclable drinking straw as a round straw. The continuous sidewall of the elongated housing can be formed with recyclable material that is both rigid to sustain use as a beverage straw and is collapsible for recycling. However, "rigid" does not preclude the multi-use recyclable drinking straw also being implemented with a flexible material, or partially flexible material, that can also sustain use as a "one-day straw" or an "all-day straw" and is recyclable. The multi-use recyclable drinking straw may also be designed to bend or with a bend at one end or the other to facilitate ease of use while drinking a beverage.

In implementations, the continuous sidewall of the elongated housing is formed with recyclable aluminum (to include anodized aluminum), or may be formed from other types of metal, alloys, and/or recyclable materials. The elongated housing of the multi-use recyclable drinking straw formed from aluminum is also a very efficient temperature conductor, and the continuous sidewall has a wall thickness which is effective for temperature conduction of a temperature of a liquid while also having a thermal mass that dissipates heat energy. The thin-walled aluminum has a lower thermal mass tending to hold less heat energy, which provides that the multi-use recyclable drinking straw is less likely to burn a user of the straw, given the heat energy is dissipated more quickly than would be the case with a thicker-walled metal straw. Notably, the continuous sidewall of the multi-use recyclable drinking straw is thinner and will change temperature more rapidly than conventional, thicker walled reusable metal straws. Accordingly, the multi-use recyclable drinking straw can better match the temperature of a liquid in a beverage container and provides a more accurate indication of the temperature of the liquid. Further, the thin wall design of the multi-use recyclable drinking straw has a much lower thermal mass than a conventional, thicker walled reusable metal straw. This lower thermal mass provides additional safety against burning because the multi-use recyclable drinking straw does not then hold as much heat energy as would a thicker walled metal straw.

The recyclable aluminum is designed for temperature conduction of the temperature of the liquid in a beverage container, and the temperature of the liquid is then discernible based on user contact with a contact area of the elongated housing of the multi-use recyclable drinking straw. For example, a user of the multi-use recyclable drinking straw may contact the contact area of the elongated housing, such as when a user contacts any portion of the straw that is generally above the top of a beverage container with his or her lips or fingers, and a temperature of the contact area approximately represents the temperature of the liquid. The temperature indication of the liquid based on the temperature conduction provides user feedback as to the temperature of the liquid in the beverage container, and can serve as a hot beverage safety warning to a user of the multi-use recyclable drinking straw. Overall, the thermal properties of the aluminum straw conduct the temperature of the beverage so that a consumer better knows the temperature of the beverage before initiating drinking through the straw, and possibly burning themselves. This safety feature will help prevent users burning parts of their mouth by having an initial thermal warning as to the approximate or likely temperature of a beverage in a container before drinking the beverage.

In another implementation of a multi-use recyclable drinking straw, the continuous sidewall of the elongated housing has an oval cross-section, forming the multi-use recyclable drinking straw as an oval straw. As noted above, the approximate temperature of a liquid in a beverage container can be discernible based on user contact with a contact area of the elongated housing of the multi-use recyclable drinking straw. The temperature indication of a liquid based on the temperature conduction provides user feedback as to the temperature of the liquid in a beverage container, and can serve as a hot beverage safety warning to a user. Notably, the oval cross-section area of the multi-use recyclable drinking straw increases the potential contact area of the elongated housing by a user over that of the approximately circular cross-section of the round multi-use recyclable drinking straw, as described above. For example, a cross-section of the oval contact area is wider and the temperature of a liquid is discernible based on user contact with the increased contact area of the elongated housing.

In other aspects, the multi-use recyclable drinking straw can used as either the described beverage straw or as a beverage stir stick, thus eliminating the conventional needs for both plastic straws and separate plastic stirs. For example, the multi-use recyclable drinking straw can have the first configuration as a beverage straw with the oval cross section as described above, and can also have a second configuration as a beverage stir stick with a flattened cross section. In this configuration as a beverage stir stick, the elongated housing of the multi-use recyclable drinking straw is collapsible, such as by applying pressure, and the continuous sidewall is maintained in the flattened cross section conducive for stirring a liquid.

While features and concepts of a multi-use recyclable drinking straw can be implemented in any number of different configurations, implementations of a multi-use recyclable drinking straw are described in the context of the following examples and methods.

FIG. 1 illustrates an example 100 of a multi-use recyclable drinking straw 102, as described herein. In this example 100, the multi-use recyclable drinking straw 102 is shown both inserted into a beverage container 104 and in a full view 106, as well as in a cross-section view 108. The multi-use recyclable drinking straw 102 has an elongated housing 110 with a continuous sidewall 112 that encloses a void space 114 conducive for conducting a liquid 116 therethrough, such as the liquid contained in the beverage container 104. As shown in this example 100, the continuous sidewall 112 of the elongated housing 110 is approximately cylindrical having a first opening 118 to the void space 114 at a first end 120 of the elongated housing and a second opening 122 to the void space at a second end 124 of the elongated housing. Although identified as a first end 120 and a second end 124 of the elongated housing 110 in this example, the opposite ends of the multi-use recyclable drinking straw 102 can be generally interchangeable.

Generally, the multi-use recyclable drinking straw 102 operates as most straws, with the second end 124 submerged in the liquid 116, such as contained in the beverage container 104, and a change in air pressure effected by a user at the first end 120 of the straw causing the liquid to rise above the liquid level in the beverage container. Essentially, with the multi-use recyclable drinking straw 102 submerged in the liquid 116 in the beverage container 104, the atmospheric pressure on the surface of the liquid is uniformly the same, including the pressure on the small amount of liquid surface that is inside of the straw. When a user sucks the air out of the portion of the straw that is above the level of the liquid, this decreases the atmospheric pressure inside of the straw, allowing the higher pressure on the rest of the surface of the liquid that is outside of the straw to push the liquid up the straw and into the mouth of the user.

As shown in the cross-section view 108, the continuous sidewall 112 of the elongated housing 110 has a circular cross-section, forming the multi-use recyclable drinking straw 102 as a round straw with a circular cross-section area (i.e., the straw is approximately round in a plane parallel to the circular cross-section). The continuous sidewall 112 of the elongated housing 110 can be formed with recyclable material that is both rigid to sustain use as a beverage straw and is collapsible for recycling. However, "rigid" does not preclude the multi-use recyclable drinking straw 102 also being implemented with a flexible material, or partially flexible material, that can also sustain use as a "one-day straw" or an "all-day straw" and is recyclable. The multi-use recyclable drinking straw 102 may also be designed to bend or with a bend at one end or the other to facilitate ease of use while drinking a beverage.

In this example 100, the continuous sidewall 112 of the multi-use recyclable drinking straw 102 accommodates the straw being both recyclable and reusable having a wall thickness 126 measured in millimeters. In implementations, the wall thickness 126 of the continuous sidewall 112 may be in a range of approximately 0.3 millimeters down to 0.125 millimeters (e.g., 0.125 mm±0.03 mm), although the multi-use recyclable drinking straw 102 is not so limited and may be designed with any other size of wall thickness. In implementations, the continuous sidewall 112 of the elongated housing 110 is formed with recyclable aluminum (to include anodized aluminum), or may be formed from other types of metal, alloys, and/or recyclable materials. Generally, the multi-use recyclable drinking straw 102 is formed from 6063 aluminum, having a length of approximately two-hundred millimeters (200 mm) and an outer diameter of approximately six millimeters (6 mm), although other straw dimensions may be used to adjust the length and/or diameter of a similar multi-use recyclable drinking straw. For example, a multi-use recyclable drinking straw may be smaller or larger, such as approximately two-hundred and fifty millimeters (250 mm) in length and/or having a diameter of approximately eight millimeters (8 mm). Notably, thin-walled 6063 aluminum tubing is generally inexpensive enough to form the multi-use recyclable drinking straw 102 as a single-use, recyclable consumer product, yet is of a high enough quality to be used many times over if desired.

Additionally, the aluminum construction allows for safe edge ends of the elongated housing 110 of the multi-use recyclable drinking straw 102. Even though the continuous sidewall 112 of the elongated housing 110 is relatively thin-walled, the edge ends are not sharp because aluminum does not hold an edge, and it may be surprising to note that the edge ends of the multi-use recyclable drinking straw 102 are actually smoother, or more dull and rounded, than conventional plastic straw consumer products. Further, a multi-use recyclable drinking straw 102 implemented with aluminum or anodized aluminum is not carcinogenic like a conventional plastic straw can be, and does not affect the taste of a beverage like a conventional plastic straw can.

In addition to the above described advantages of the multi-use recyclable drinking straw 102 being formed from aluminum (to include anodized aluminum), the elongated housing 110 formed from aluminum is also a very efficient temperature conductor. As noted above, the continuous sidewall 112 of the elongated housing 110 has a wall thickness 126 which is effective for temperature conduction of a temperature of the liquid 116 while also having a thermal mass that dissipates heat energy. The thin-walled aluminum has a lower thermal mass tending to hold less heat energy, which provides that the multi-use recyclable drinking straw 102 is less likely to burn a user of the straw, given the heat energy is dissipated more quickly than would be the case with a thicker-walled metal straw.

The recyclable aluminum is designed for temperature conduction of the temperature of the liquid 116 in the beverage container 104, and the temperature of the liquid is then discernible based on user contact with a contact area 128 of the elongated housing 110 of the multi-use recyclable drinking straw. For example, a user of the multi-use recyclable drinking straw 102 may contact the contact area 128 of the elongated housing 110, such as when a user contacts any portion of the straw that is generally above the top of the beverage container 104 with his or her lips or fingers, and a temperature of the contact area 128 approximately represents the temperature of the liquid. The temperature indication of the liquid 116 based on the temperature conduction provides user feedback as to the temperature of the liquid in the beverage container 104, and can serve as a hot beverage safety warning to a user of the multi-use recyclable drinking straw. Overall, the thermal properties of the aluminum straw conduct the temperature of the beverage so that a consumer better knows the temperature of the beverage before initiating drinking through the straw, and possibly burning themselves. This safety feature will help prevent users burning parts of their mouth by having an initial thermal warning as to the approximate or likely temperature of a beverage in a container before drinking the beverage.

Figure 2:
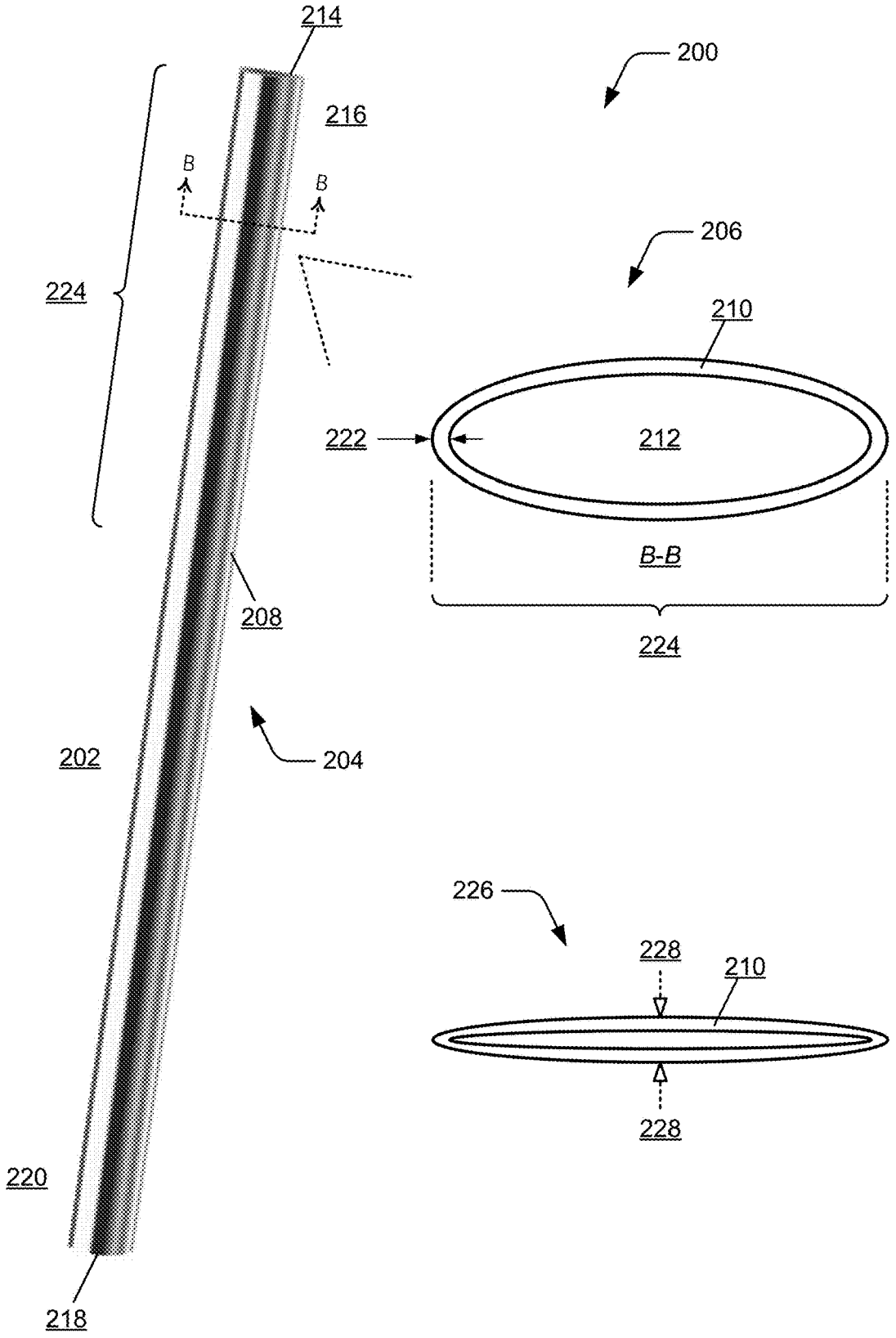
FIG. 2 illustrates another example of a multi-use recyclable drinking straw in accordance with one or more implementations of the aspects described herein.

FIG. 2 illustrates an example 200 of a multi-use recyclable drinking straw 202, as described herein. In this example 200, the multi-use recyclable drinking straw 202 is shown in a full view 204, as well as in a cross-section view 206. The multi-use recyclable drinking straw 202 has an elongated housing 208 with a continuous sidewall 210 that encloses a void space 212 conducive for conducting a liquid therethrough, such as the liquid 116 contained in the beverage container 104 as shown and described with reference to FIG. 1. As shown in this example 200, the continuous sidewall 210 of the elongated housing 208 is cylindrically oval having a first opening 214 to the void space 212 at a first end 216 of the elongated housing and a second opening 218 to the void space at a second end 220 of the elongated housing. Although identified as a first end 216 and a second end 220 of the elongated housing 208 in this example, the opposite ends of the multi-use recyclable drinking straw 202 can be generally interchangeable.

As shown in the cross-section view 206, the continuous sidewall 210 of the elongated housing 208 has an oval cross-section, forming the multi-use recyclable drinking straw 202 as an oval straw with an oval cross-section area (i.e., the straw is approximately oval in a plane parallel to the oval cross-section). The continuous sidewall 210 of the elongated housing 208 can be formed with recyclable material that is both rigid to sustain use as a beverage straw and is collapsible for recycling. However, "rigid" does not preclude the multi-use recyclable drinking straw 202 also being implemented with a flexible material, or partially flexible material, that can also sustain use as a "one-day straw" or an "all-day straw" and is recyclable. The multi-use recyclable drinking straw 202 may also be designed to bend or with a bend at one end or the other to facilitate ease of use while drinking a beverage.

In this example 200, the continuous sidewall 210 of the multi-use recyclable drinking straw 202 accommodates the straw being both recyclable and reusable having a wall thickness 222 measured in millimeters. In implementations, the wall thickness 222 of the continuous sidewall 112 may be in a range of approximately 0.3 millimeters down to 0.125 millimeters (e.g., 0.125 mm±0.03 mm), although the multi-use recyclable drinking straw 102 is not so limited and may be designed with any other size of wall thickness. In implementations, the continuous sidewall 210 of the elongated housing 208 is formed with recyclable aluminum or anodized aluminum, or may be formed from other types of metal, alloys, and/or recyclable materials. Generally, the multi-use recyclable drinking straw 202 can be formed from 6063 aluminum, which provides the features and aspects described with reference to the multi-use recyclable drinking straw 102 shown in FIG. 1.

Similar to the multi-use recyclable drinking straw 102 shown in FIG. 1, The multi-use recyclable drinking straw 202 is formed from the recyclable aluminum that is designed for temperature conduction of the temperature of a liquid in a beverage container, and the temperature of the liquid is then discernible based on user contact with a contact area 224 of the elongated housing 208 of the multi-use recyclable drinking straw. For example, a user of the multi-use recyclable drinking straw 202 may contact the contact area 224 of the elongated housing 208, such as when a user contacts any portion of the straw that is generally above the liquid contained in a beverage container with his or her lips or fingers, and a temperature of the contact area 224 approximately represents the temperature of the liquid.

The temperature indication of a liquid based on the temperature conduction provides user feedback as to the temperature of the liquid in a beverage container, and can serve as a hot beverage safety warning to a user of the multi-use recyclable drinking straw. Notably, the oval cross-section area of the multi-use recyclable drinking straw 202 increases the potential contact area of the elongated housing 208 by a user over that of the approximately circular cross-section of the round multi-use recyclable drinking straw 102 shown in FIG. 1. For example, a cross-sectional view 224 of the oval contact area illustrates how much wider of a contact area the multi-use recyclable drinking straw 202 provides for user contact with the oval straw, such as with his or her lips or fingers, and from which the temperature of a liquid is discernible based on user contact with the increased contact area of the elongated housing. Overall, the thermal properties of the aluminum straw conduct the temperature of the beverage so that a consumer better knows the temperature of the beverage before initiating drinking through the straw, and possibly burning themselves. This safety feature will help prevent users burning parts of their mouth by having an initial thermal warning as to the approximate or likely temperature of a beverage in a container before drinking the beverage.

In other aspects, the multi-use recyclable drinking straw 202 can used as either the described beverage straw or as a beverage stir stick, thus eliminating the conventional needs for both plastic straws and separate plastic stirs. For example, the multi-use recyclable drinking straw 202 can have the first configuration as a beverage straw with the oval cross section as shown in the cross-section view 206, and can have a second configuration as a beverage stir stick with a flattened cross section as shown in the cross section view 226. In this second configuration as a beverage stir stick, the elongated housing 208 of the multi-use recyclable drinking straw 202 is collapsible such that the continuous sidewall 210 is maintained in the flattened cross section conducive for stirring a liquid. For example, a user can simply exert pressure 228 on the elongated sides of the continuous sidewall 210, such as using one's fingers and pressing the opposite sides of the elongated housing 208 together. The continuous sidewall 210 of the elongated housing 208 is formed with the recyclable aluminum that is both rigid to sustain use as the beverage straw and collapsible for use as the beverage stir stick.

Additionally, any overall length of the multi-use recyclable drinking straw 202 can be pressed together to form a beverage stir stick, or a portion of a beverage stir stick, that can then be used to stir a beverage in a beverage container. For example, the entire length of the multi-use recyclable drinking straw 202 can be pressed together such that the first opening 213 and the second opening 218 to the void space 212 are approximately closed in the second configuration as a beverage stir stick. Alternatively, only one end of the multi-use recyclable drinking straw 202 may be pressed together to form a portion of a beverage stir stick. Notably, the first configuration of the multi-use recyclable drinking straw 202 as the beverage straw with the oval cross section is deformable to the second configuration as the beverage stir stick with the flattened cross section, and the second configuration as the beverage stir stick with the flattened cross section is reformable to the first configuration as the beverage straw with the oval cross section. For example, a user may exert pressure 228 on the opposite collapsed sides of the continuous sidewall 210, which forces the elongated sides out to approximately reform the multi-use recyclable drinking straw as a beverage straw.

Figure 3:
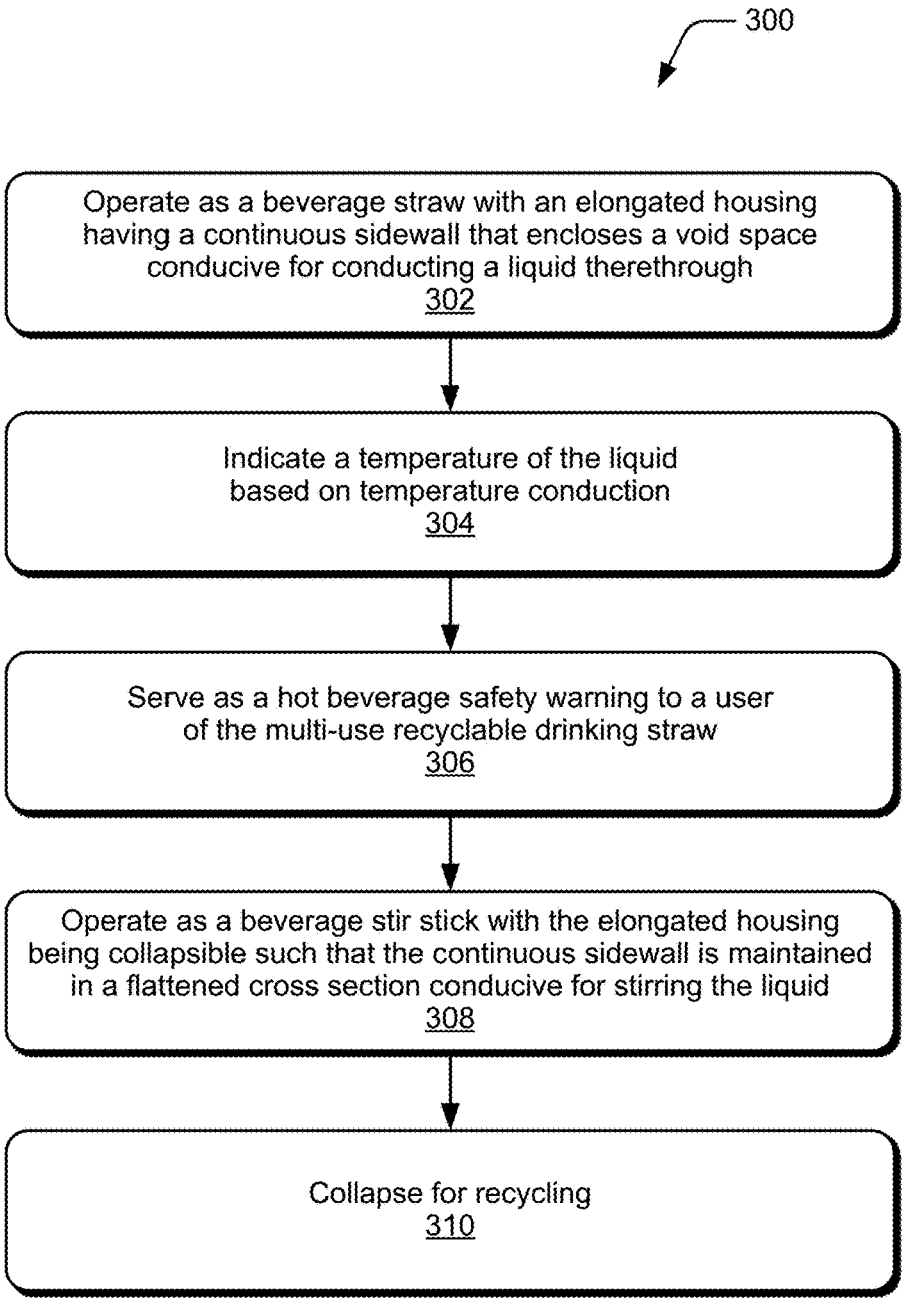
FIG. 3 illustrates an example method of a multi-use recyclable drinking straw in accordance with one or more implementations of the aspects described herein.

FIG. 3 illustrates an example method 300 of a multi-use recyclable drinking straw. The order in which the method is described is not intended to be construed as a limitation, and any number or combination of the described method operations can be performed in any order to perform a method, or an alternate method.

At 302, a multi-use recyclable drinking straw operates as a beverage straw with an elongated housing having a continuous sidewall that encloses a void space conducive for conducting a liquid therethrough. For example, the multi-use recyclable drinking straw 102 (FIG. 1) is usable as a beverage straw, having the elongated housing 110 with the continuous sidewall 112 that encloses the void space 114 conducive for conducting the liquid 116 therethrough. The continuous sidewall 112 of the elongated housing 110 has a circular cross-section, forming the multi-use recyclable drinking straw 102 as a round straw with a circular cross-section area. Additionally, the continuous sidewall 112 of the elongated housing 110 is formed with recyclable material that is both rigid to sustain use as a beverage straw and is collapsible for recycling. The recyclable material can include aluminum (to include anodized aluminum), or may be formed from other types of metal, alloys, and/or recyclable materials.

Similarly, the multi-use recyclable drinking straw 202 (FIG. 2) is usable as a beverage straw, having the elongated housing 208 with the continuous sidewall 210 that encloses the void space 212 conducive for conducting the liquid 116 therethrough. The continuous sidewall 210 of the elongated housing 208 has an oval cross-section, forming the multi-use recyclable drinking straw 202 as an oval straw with an oval cross-section area. Additionally, the continuous sidewall 210 of the elongated housing 208 is formed with recyclable material that is both rigid to sustain use as a beverage straw and is collapsible for use as a beverage stir stick and/or for recycling. Although only two examples of a multi-use recyclable drinking straw are described herein and shown as a round straw in FIG. 1 and shown as an oval straw in FIG. 2, a multi-use recyclable drinking straw may be implemented in other shapes, sizes, and configurations, such as a square or rectangular straw, and bendable straw, a bent straw, a multi-sided straw, and the like.

At 304, a temperature of the liquid is indicated based on temperature conduction and, at 306, serves as a hot beverage safety warning to a user of the multi-use recyclable drinking straw. For example, the multi-use recyclable drinking straw 102 is implemented with recyclable aluminum designed for temperature conduction of the temperature of the liquid 116 in the beverage container 104, and the temperature of the liquid is then discernible based on user contact with the contact area 128 of the elongated housing 110 of the multi-use recyclable drinking straw. Notably, a user of the multi-use recyclable drinking straw 102 may contact the contact area 128 of the elongated housing 110, such as when a user contacts any portion of the straw that is generally above the top of the beverage container 104 with his or her lips or fingers, and a temperature of the contact area 128 approximately represents the temperature of the liquid. The temperature indication of the liquid 116 based on the temperature conduction provides user feedback as to the temperature of the liquid in the beverage container 104, and can serve as a hot beverage safety warning to a user of the multi-use recyclable drinking straw.

Similarly, the multi-use recyclable drinking straw 202 is implemented with recyclable aluminum designed for temperature conduction of the temperature of a liquid in a beverage container, and the temperature of the liquid is then discernible based on user contact with the contact area 224 of the elongated housing 208 of the multi-use recyclable drinking straw. For example, a user of the multi-use recyclable drinking straw 202 may contact the contact area 224 of the elongated housing 208, such as when a user contacts any portion of the straw that is generally above the liquid contained in a beverage container with his or her lips or fingers, and a temperature of the contact area 224 approximately represents the temperature of the liquid. The temperature indication of a liquid based on the temperature conduction provides user feedback as to the temperature of the liquid in a beverage container, and can serve as a hot beverage safety warning to a user of the multi-use recyclable drinking straw. Notably, the oval cross-section area of the multi-use recyclable drinking straw 202 increases the potential contact area of the elongated housing 208 by a user over that of the approximately circular cross-section of the round multi-use recyclable drinking straw 102.

At 308, a multi-use recyclable drinking straw operates as a beverage stir stick with the elongated housing being collapsible such that the continuous sidewall is maintained in a flattened cross section conducive for stirring the liquid. For example, the multi-use recyclable drinking straw 202 is usable as a beverage stir stick with a flattened cross section, where the elongated housing 208 of the multi-use recyclable drinking straw 202 is collapsible such that the continuous sidewall 210 is maintained in the flattened cross section conducive for stirring a liquid. The entire length of the multi-use recyclable drinking straw 202 can be pressed together such that the first opening 213 and the second opening 218 to the void space 212 are approximately closed in the configuration as a beverage stir stick. Alternatively, any overall length of the multi-use recyclable drinking straw 202 can be pressed together to form a beverage stir stick, or a portion of a beverage stir stick, that can then be used to stir a beverage in a beverage container.

At 310, the multi-use recyclable drinking straw collapses for recycling. For example, both of the multi-use recyclable drinking straw 102 (FIG. 1) and the multi-use recyclable drinking straw 202 (FIG. 2) are collapsible for aluminum recycling.

Although implementations of multi-use recyclable drinking straw have been described in language specific to features and/or methods, the subject of the appended claims is not necessarily limited to the specific features or methods described. Rather, the specific features and methods are disclosed as example implementations of multi-use recyclable drinking straw, and other equivalent features and methods are intended to be within the scope of the appended claims. Further, various different examples are described and it is to be appreciated that each described example can be implemented independently or in connection with one or more other described examples.

The invention claimed is:

1. A multi-use recyclable drinking straw, comprising:

an elongated housing having a continuous sidewall that encloses a void space conducive for conducting a liquid;

a contact area of the elongated housing configured to provide a temperature indication of the liquid, the temperature indication serving as a hot beverage safety warning to a user of the multi-use recyclable drinking straw; and a configuration of the multi-use recyclable drinking straw as a beverage stir stick, the elongated housing being collapsible such that the continuous sidewall is maintained in a flattened cross section conducive for stirring the liquid.

2. The multi-use recyclable drinking straw as recited in claim 1, wherein a temperature of the liquid is discernible based on user contact with the contact area of the elongated housing.

3. The multi-use recyclable drinking straw as recited in claim 1, wherein the continuous sidewall of the elongated housing is approximately cylindrical having a first opening to the void space at a first end of the continuous sidewall and a second opening to the void space at a second end of the continuous sidewall.

4. The multi-use recyclable drinking straw as recited in claim 1, wherein the continuous sidewall of the elongated housing is formed with recyclable material that is both rigid to sustain use as a beverage straw and collapsible for recycling.

5. The multi-use recyclable drinking straw as recited in claim 1, wherein the continuous sidewall of the elongated housing is formed with recyclable aluminum.

6. The multi-use recyclable drinking straw as recited in claim 5, wherein the recyclable aluminum is designed for temperature conduction of a temperature of the liquid, and the contact area of the elongated housing is configured to provide the temperature indication of the liquid based on the temperature conduction.

7. The multi-use recyclable drinking straw as recited in claim 5, wherein the recyclable aluminum is designed for temperature conduction of a temperature of the liquid, and a temperature of the contact area of the elongated housing approximately represents the temperature of the liquid.

8. The multi-use recyclable drinking straw as recited in claim 1, wherein the continuous sidewall of the elongated housing has a circular cross-section, forming the multi-use recyclable drinking straw as a round straw with a circular cross-section area.

9. The multi-use recyclable drinking straw as recited in claim 1, wherein the continuous sidewall of the elongated housing has an oval cross-section, forming the multi-use recyclable drinking straw as an oval straw with an oval cross-section area.

10. The multi-use recyclable drinking straw as recited in claim 9, wherein the oval cross-section area of the multi-use recyclable drinking straw increases the contact area of the elongated housing, from which the temperature of the liquid is discernible based on user contact with the increased contact area of the elongated housing.

11. The multi-use recyclable drinking straw as recited in claim 1, wherein the continuous sidewall has a wall thickness of approximately 0.125 millimeters, effective for temperature conduction of a temperature of the liquid while having a thermal mass that dissipates heat energy.

12. A multi-use recyclable drinking straw, comprising:

a first configuration as a beverage straw with an elongated housing having a continuous sidewall with an oval cross section, the continuous sidewall enclosing a void space conducive for conducting a liquid; and a second configuration as a beverage stir stick, the elongated housing being collapsible such that the continuous sidewall is maintained in a flattened cross section conducive for stirring the liquid.

13. The multi-use recyclable drinking straw as recited in claim 12, wherein:

the first configuration as the beverage straw with the oval cross section is deformable to the second configuration as the beverage stir stick with the flattened cross section; and the second configuration as the beverage stir stick with the flattened cross section is reformable to the first configuration as the beverage straw with the oval cross section.

14. The multi-use recyclable drinking straw as recited in claim 12, further comprising a contact area of the elongated housing configured to provide a temperature indication of the liquid, the temperature indication serving as a hot beverage safety warning to a user of the multi-use recyclable drinking straw.

15. The multi-use recyclable drinking straw as recited in claim 12, wherein:

the elongated housing in the first configuration has a first opening to the void space at a first end of the continuous sidewall and a second opening to the void space at a second end of the continuous sidewall; and the first opening and the second opening to the void space are approximately closed in the second configuration of the elongated housing.

16. The multi-use recyclable drinking straw as recited in claim 12, wherein the continuous sidewall of the elongated housing is formed with recyclable aluminum that is both rigid to sustain use as the beverage straw and collapsible for use as the beverage stir stick.

17. The multi-use recyclable drinking straw as recited in claim 16, wherein the recyclable aluminum is designed for temperature conduction of a temperature of the liquid, and a contact area of the elongated housing is configured to provide a temperature indication of the liquid based on the temperature conduction.

18. The multi-use recyclable drinking straw as recited in claim 16, wherein the recyclable aluminum is designed for temperature conduction of a temperature of the liquid, and a temperature of the contact area of the elongated housing approximately represents the temperature of the liquid.

19. The multi-use recyclable drinking straw as recited in claim 12, wherein the continuous sidewall of the elongated housing is formed with recyclable aluminum and a temperature of the liquid is discernible based on user contact with the elongated housing.

20. The multi-use recyclable drinking straw as recited in claim 12, wherein the continuous sidewall has a wall thickness of approximately 0.125 millimeters, effective for temperature conduction of a temperature of the liquid while having a thermal mass that dissipates heat energy.

* * * * *